United States Patent [19]

Hamlin

[11] Patent Number: 4,598,664

[45] Date of Patent: Jul. 8, 1986

[54] DISPENSING APPARATUS

[76] Inventor: Jerry F. Hamlin, 874 Shirley La., Boulder City, Nev. 89005

[21] Appl. No.: 709,517

[22] Filed: Mar. 7, 1985

[51] Int. Cl.[4] ..... B05B 15/12

[52] U.S. Cl. ..... 118/325; 427/424; 118/32; 118/43

[58] Field of Search ..... 427/421, 424; 118/325, 118/32, 43

[56] References Cited

U.S. PATENT DOCUMENTS

| | | | |
|---|---|---|---|
| 598,053 | 1/1898 | Lewis | 222/162 |
| 1,250,894 | 12/1917 | Kately et al. | 118/325 X |
| 2,673,008 | 3/1954 | Ryan | 222/162 |
| 3,100,066 | 8/1963 | Campbell | 118/325 X |
| 3,652,174 | 3/1972 | Boone | 118/325 X |
| 3,776,773 | 12/1973 | Taft | 118/325 |
| 3,795,355 | 3/1974 | Gerstein | 206/205 X |
| 3,796,185 | 3/1974 | Boone | 118/325 |
| 3,804,061 | 4/1974 | Cassar et al. | 118/325 X |

*Primary Examiner*—Shrive P. Beck

*Attorney, Agent, or Firm*—Harry M. Weiss & Associates

[57] ABSTRACT

A dispensing apparatus for impregnating paper with fragrances or other substances is provided having a flat top member supported by two flat members. An aerosol container fits into a U-shaped support attached to the side of the leg members. An elongated hollow member extending across the flat top member is used to dispense substances across paper unrolled from a roll of paper supported between the leg members. A cantilevered lever having an aperture engages the stem of the aerosol container. As the lever is pushed down, substances sprayed from the container pass through the aperture into the elongated hollow member unformly impregnating the paper under the member. A pump bottle may be used instead of the aerosol container if desired. Another embodiment of the dispensing apparatus for impregnating individual sheets of tissue or paper is provided having two flat leg members supporting a removable upper portion. Front, bottom and back sides are attached to the leg members forming a compartment for holding a plurality of individual sheets. The apparatus has the same type of U-shaped support, cantilevered lever and elongated hollow member as the first embodiment. The sheets are pulled through an elongated slot in the removable upper portion and under a top plate and the elongated hollow member where they are sprayed with a substance of fragrance.

17 Claims, 8 Drawing Figures

DISPENSING APPARATUS

BACKGROUND OF THE INVENTION

This invention relates generally to dispensing apparatus and, more particularly, to an apparatus for dispensing substances, fragrances or the like onto sheets or paper or tissue or onto tissues or paper obtained from a roll.

Very often, it may be advantageous to impregnate a sheet of tissue or piece of paper with a fragrance or other substance. For example, a germicide or disinfectant may be sprayed onto a piece of paper used for cleaning purposes. A decongestant could also be sprayed onto a tissue and used by a person experiencing a cold, nasal congestion, etc. Also, it may be desirable to spray a mild perfume, fragrance or deodorant onto different types of tissues or paper.

The different substances may be conveniently sprayed onto sheets of paper or tissue or onto tissues or paper obtained from a roll by an aerosol container, pump bottle or the like. An apparatus may be used to hold the aerosol container or pump bottle and the tissues or paper. The apparatus must provide means for spraying the different substances uniformly across each sheet or piece of tissue or paper.

Accordingly, there is a need for a dispensing apparatus capable of holding tissues or paper and an aerosal container, pump bottle or the like which provides a means for spraying different substances such as fragrances, disinfectants, deodorants or the like uniformly across the tissues or paper.

SUMMARY OF THE INVENTION

It is an object of this invention to provide a dispensing apparatus used for dispensing substances across sheets or pieces of tissue or paper.

It is another object of this invention to provide a dispensing apparatus capable of holding sheets of tissue or paper.

It is another object of this invention to provide a dispensing apparatus capable of holding a roll of tissue or paper.

It is another object of this invention to provide a dispensing apparatus capable of holding an aerosol container or pump bottle.

It is another object of this invention to provide a dispensing apparatus having a means for spraing or dispensing different substances uniformly across each sheet or piece of tissue or paper.

It is another object of this invention to provide a dispensing apparatus which allows each sheet or piece of tissue or paper to be conveniently removed from the apparatus after it is sprayed or impregnated with a substance.

In accordance with one embodiment of this invention, a dispensing apparatus for impregnating paper with fragrances or other substances is provided having a flat top member supported by two flat members. An aerosol container or pump bottle fits into a u-shaped support attached to the side of one of the leg members. An elongated hollow member extending across the flat top member is used to dispense substances across paper unrolled from a roll of paper supported between the leg members. A cantilevered lever having an aperture engages the stem of the aerosol container. As the lever is pushed down, substances sprayed from the container pass through the aperture into the elongated hollow member uniformly impregnating the paper under the member. The pump bottle may be used instead of the aerosol container if desired.

In accordance with another embodiment of the invention, a dispensing apparatus for impregnating individual sheets of tissue or paper is provided having two flat leg members supporting a removable upper portion. Front, bottom and back sides are attached to the leg members forming a compartment for holding a plurality of individual sheets. The apparatus has the same type of u-shaped support, cantilevered lever and elongated hollow member as the first embodiment. The sheets are pulled through an elongated slot in the removable upper portion and under a top plate and the elongated hollow member where they are sprayed with a substance or fragrance.

The foregoing and other objects, features and advantages of this invention will be apparent from the following, more particular, description of the preferred embodiment of the invention as illustrated in the accompanying drawings.

DESCRIPTION OF THE PREFERRED EMBODIMENT

Figure 1:
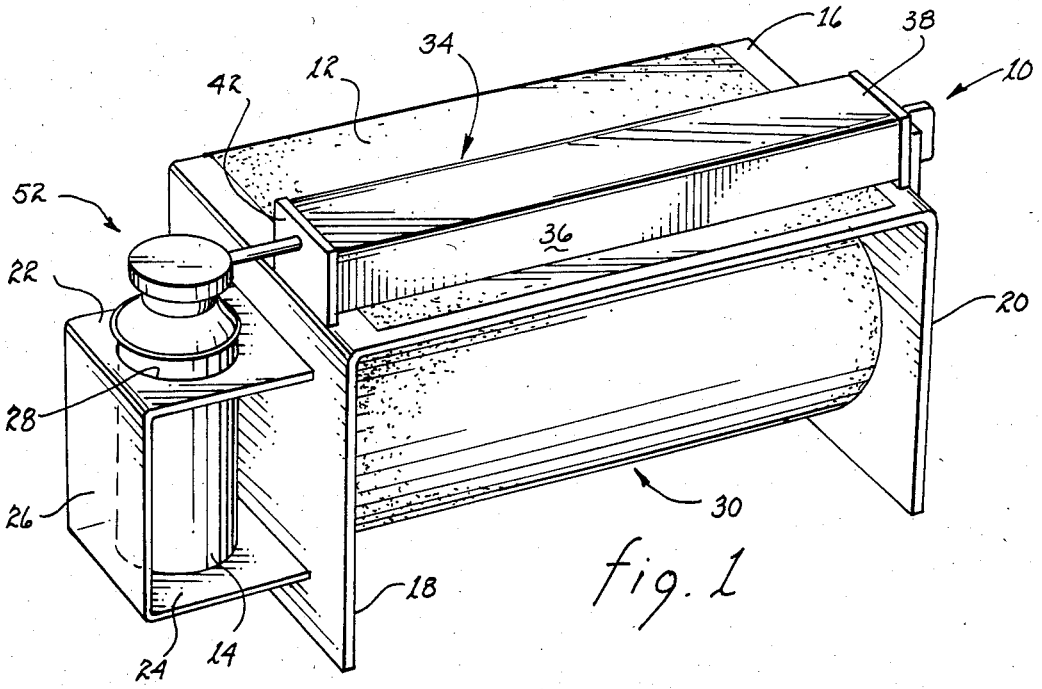
FIG. 1 is a perspective view of a dispensing apparatus used for holding a roll of paper or tissue.

FIG. 1 shows a dispensing apparatus generally designated by references number 10, used for impregnating paper 12 with fragrances or other substances sprayed from an aerosol container 14. The dispensing apparatus 10 has a flat top member 16 supported by two flat leg members 18 and 20. As shown in FIG. 1, the aerosol container 14 fits into a u-shaped support attached to the side of flat leg member 18. The u-shaped support has top, bottom and vertical sides 22, 24 and 26, respectively. The top of the aerosol container 14 extends through an aperture 28 in the top side 22.

Figure 2:
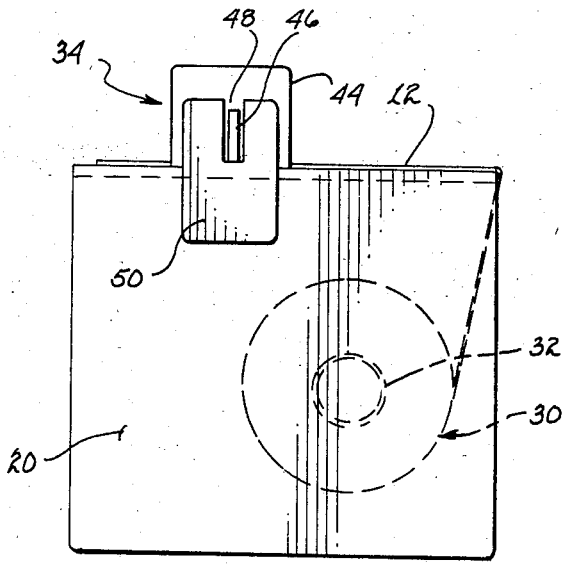
FIG. 2 is a side view of the apparatus of FIG. 1 showing how one end of an elongated hollow member slidable engages a slotted support attached to the apparatus.

Referring to FIGS. 1 and 2, an elongated member 32 supporting a roll of paper 30 is attached to leg members 18 and 20. Preferably, the ends of the elongated member 32 are removably attached to leg members 18 and 20 in order to allow the roll 30 is to be periodically replaced. Paper 12 is unrolled from roll 30 until it passes over the back edge of flat top member 16 and under an elongated hollow member 34.

Figure 3:
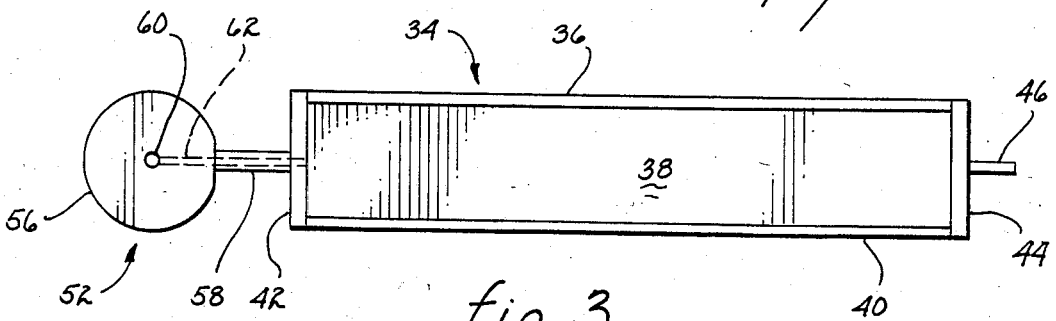
FIG. 3 is a bottom view of the elongated hollow member.

The elongated hollow member 34 is used to dispense fragrances or other substances sprayed from the aerosol container 14 onto the paper 12 passing under the member. A bottom view of the elongated hollow member 34 is shown in FIG. 3. The member 34 has a generally u-shaped traverse cross-section, a top 38, elongated sides 36 and 40, and ends 42 and 44. End 44 has an extension 46 attached to it which removably engages a slot 48 in a slotted support 50 attached to leg member 20. The other end 42 of the member 34 has a cantilevered lever 52 coupled to it. The cantilevered lever 52 engages a stem 54 of the aerosol container 14 as shown in FIG. 4.

Figure 4:
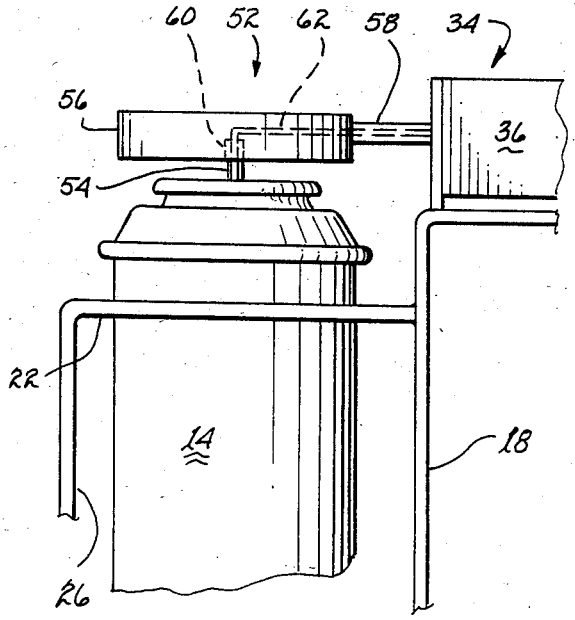
FIG. 4 is a detailed view of an aerosol container and cantilevered lever showing how the stem of the aerosol container valve engages an aperture in the cantilevered lever.

The cantilevered lever 52 has a force applying member 56 and a connecting member 58 as illustrated in FIG. 4. The connecting member 58 connects the force applying member 56 to end 42 of the elongated hollow member 34. The force applying member 56 has an aperture 60 passing through its bottom surface and approximately half way through it as shown in FIG. 4. Aperture 60 engages the stem 54 of the aerosol container 14. An aperture 62 passing longitudinally through the connecting member 58 and into the force applying member 56 until it communicates with aperture 60 forming a passageway into the elongated hollow member 34. The aperture 62 exits the end of the elongated hollow member 34 allowing substances sprayed from the aerosol container 14 to enter member 34.

The dispensing apparatus 10 is used by first rolling paper 12 from roll 30 until it passes under the member 34 as shown in FIG. 1. A person then pushes downward on the force applying member 56 causes a substance to be sprayed from the aerosol container 14 through aperture 62 and into the elongated hollow member 34. Pressure from the aerosol container 14 causes the substance to travel along the length of the elongated hollow member 34. As a result, the paper 12 under the member 34 is uniformly impregnated with the substance sprayed from the container 14.

Figure 5:
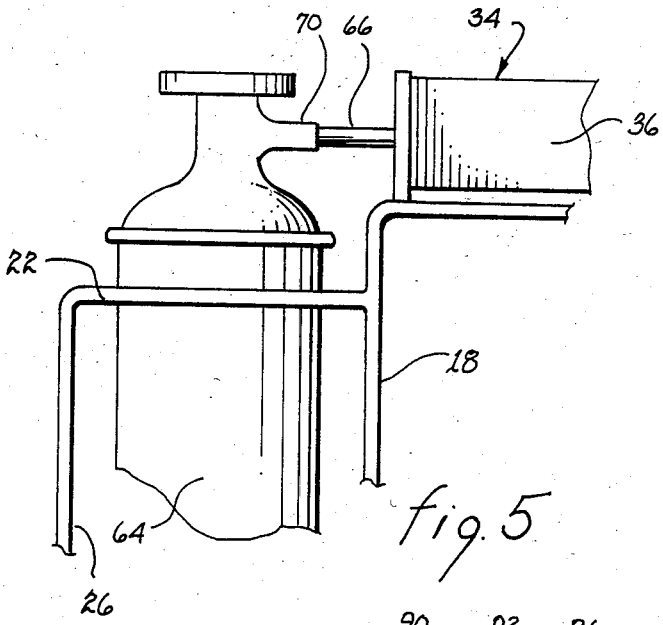
FIG. 5 is a view showing how a pump bottle may be used instead of the aerosal container.

FIG. 5 shows how a pump bottle 64 which may be used in place of the aerosol container 14. Any type of pump bottle may be used to force substances from the bottle through member 66 and into the elongated hollow member 34. Alternatively, nozzle 70 may be designed to directly engage the elongated hollow member 34, eliminated member 66.

Figure 6:
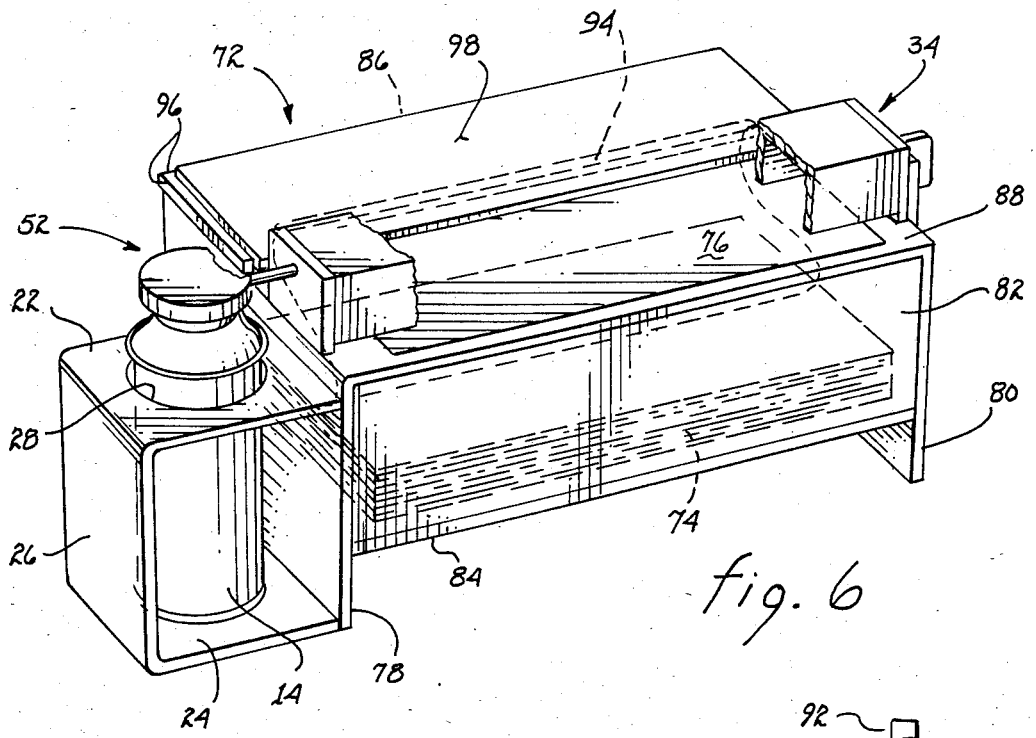
FIG. 6 is a perspective view of another embodiment of the dispensing apparatus used for holding a plurality of sheets of tissue or paper showing part of the elongated hollow member broken away.

Another embodiment of the invention is shown in FIG. 6. A dispensing apparatus 72 used for holding a plurality of sheets of tissue or paper 74 is shown in this figure. The dispensing apparatus 72 has the same elongated hollow member 34, cantilevered lever 52 and u-shaped support used for the embodiment shown in FIG. 1. The aerosol container 14 or pump bottle 64, shown in FIGS. 4 and 5, may be used with the dispensing apparatus 72. The apparatus 72 is used for impregnating each individual sheet of tissue or paper 76 with a substance or fragrance.

The dispensing apparatus 72 has two flat leg members 78 and 80. The u-shaped support holding the aerosol container is attached to leg member 78. Front, bottom and back sides 82, 84 and 86, respectively, are attached to the leg members 78 and 80 forming a compartment for holding the plurality of sheets of tissue or paper 74. The dispensing apparatus 72 has a removable upper portion 88 which removably engages the top of the apparatus.

Figure 8:
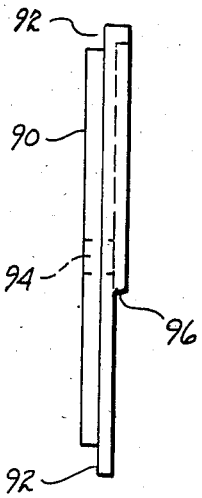
FIG. 8 is an end view of the removable upper portion.
Figure 7:
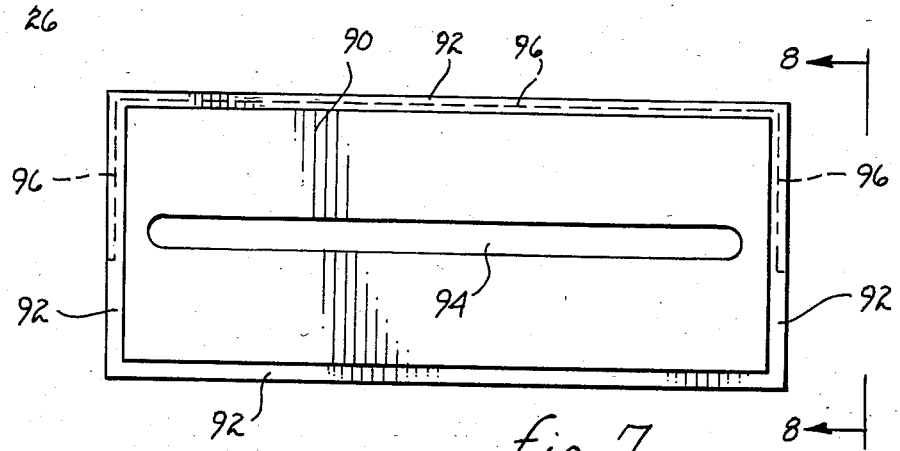
FIG. 7 is a bottom view of the removable upper portion of the apparatus.

FIGS. 7 and 8 show bottom and end views of the removable upper portion 88. The upper portion 88 has a flat rectangular-shaped extension 90 surrounded by a ledge 92. The ledge 92 rests on the outer periphery of the top of the dispensing apparatus 72 when the removable upper portion 88 is placed on top of the apparatus. An elongated slot 94 passes through the removable upper portion 88 as shown in FIGS. 7 and 8. Raised strips 96 are attached to the top surface of the removable upper portion 88. The raised strips 96 extend across one of the two longer sides of the removable upper portion 88 and down the two shorter sides as shown in FIG. 7.

Each individual sheet of tissue or paper 76 is pulled through the elongated slot 94 from the plurality of sheets 74 resting on the bottom side 84. A top plate 98 rests on top of the removable upper portion 88 and is held in place by the raised strips 96. The top plate 98 covers the elongated slot 94 and helps to keep each individual sheet 76 flat against the removable upper portion 88 as it is pulled through the elongated slot 94. The top plate 98 also assists in guiding each sheet 76 under the elongated hollow member 34.

The sheets 74 are preferably connected together such that each sheet 76 pulls another sheet 76 from the plurality of sheets 74 through the slot 94 as each sheet is pulled under the elongated hollow member 34. Each sheet 76 may be sprayed with a substance or fragrances after it is pulled under member 34. As a result, individual sheets of tissue or paper may be conveniently impregnated by a substance sprayed uniformly across the sheets.

The above discussion is given by way of example only. Changes in form and detail may be made by one skilled in the art without departing from the scope of the invention as defined by the appended claims.

I claim:

1. A dispensing apparatus for impregnating paper unrolled from a roll of paper with a substance, comprising:

two leg members supporting said roll of paper;

a top member supported by said two leg members;

aerosol spreading means located on top of said top member for distributing said substances uniformly across said paper, said aerosol spreading means comprises an elongated member having a generally u-shaped transverse cross-section, a top side, a front side, a back side and two end sides to allow a continuous impregnation substantially along the entirety of a desired portion of said paper; and support means attached to one of said two leg members for holding a means for introducing said substance into said spreading means.

2. The dispensing apparatus of claim 1 further comprising a cantilevered lever operably coupled to said spreading means and to said means for introducing said substance into said distributing means.

3. The dispensing apparatus of claim 2 wherein said canvilevered lever comprises a force applying member and a connecting member.

4. The dispensing apparatus of claim 1 wherein said two leg members and said top member comprise relatively flat sheet members.

5. The dispensing apparatus of claim 1 wherein said support means comprises a generally U-shaped support.

6. The dispensing apparatus of claim 5 wherein said means for introducing said substance into said distributing means is an aerosol container.

7. The dispensing apparatus of claim 6 further comprising a cantilevered lever operably coupled to a stem of said aerosol container and one of said two end sides of said elongated member.

8. The dispensing apparatus of claim 5 wherein said means for introducing said substance into said distributing means is a pump bottle.

9. A dispensing apparatus for impregnating paper unrolled from a roll of paper with a substance, comprising:

two relatively flat leg members supporting said roll of paper;

a relatively flat top member supported by said two relatively flat leg members;

an elongated member means located on top of said relatively flat top member for distributing said aerosol substance uniformly across said paper, said elongated member has a generally u-shaped tranverse cross-section, a top side, a front side, a back side and two end sides to allow a continuous distribution of said aerosol substance substantially along the entirety of a desired portion of said paper; and support means attached to one of said two relatively flat leg members for holding one of an aerosol container and a pump bottle.

10. The dispensing apparatus of claim 9 further comprising a cantilevered lever operably coupled to said aerosol container and said elongated member means, said cantilevered lever having apertures forming a passageway between a stem of said aerosol container and said elongated member means.

11. A dispensing apparatus for impregnating individual sheets of tissue or paper with a substance, comprising:

a compartment means for holding said sheets;

a removable upper portion removably engaging the top of said compartment means, said removable upper portion having an elongated slot passing therethrough;

aerosol spreading means located on top of said removable upper portion for distributing said substance uniformly across said sheets, said aerosol spreading means comprises an elongated member having a generally u-shaped transverse cross-section, a top side, a front side, a back side and two end sides to allow a continuous distribution of said aerosol substance substantially along the entirety of a desired portion of said individual sheets; and support means attached to said compartment means for holding a means for introducing said aerosol substance into said aerosol spreading means.

12. The dispensing apparatus of claim 11 further comprising a top plate located on top of said removable upper plate.

13. The dispensing apparatus of claim 12 further comprising a cantilevered lever operably coupled to said spreading means and to said means for introducing said substance into said spreading means.

14. The dispensing apparatus of claim 12 wherein said compartment means comprises two leg members supporting a front side, a bottom side and a back side.

15. The dispensing apparatus of claim 14 wherein said removable upper portion has a flat rectangular-shaped extension, a ledge extending at least part of the way around the periphery of said removable upper portion and raised strips located on top of said removable upper portion.

16. The dispensing apparatus of claim 11 wherein said support means comprises a generally U-shaped support.

17. The dispensing apparatus of claim 16 further comprising a cantilevered lever operably coupled to one of said two ends of said elongated member and to said means for introducing said substance into said spreading means.

* * * * *